United States Patent [19]

Logan

[11] 4,178,540

[45] Dec. 11, 1979

[54] SATURABLE REACTORS

[75] Inventor: Robert J. Logan, Sheffield, England

[73] Assignee: Inductive Controls Limited, Sheffield, England

[21] Appl. No.: 888,339

[22] Filed: Mar. 20, 1978

[30] Foreign Application Priority Data

Mar. 22, 1977 [GB] United Kingdom ..... 12131/77

[51] Int. Cl.[2] ..... G05F 1/32

[52] U.S. Cl. ..... 323/89 R; 323/87; 323/89 M

[58] Field of Search ..... 323/56, 75 S, 87, 89 R, 323/89 B, 89 P, 89 T, 89 M; 330/8, 63

[56] References Cited

U.S. PATENT DOCUMENTS

| | | | |
|---|---|---|---|
| 2,509,380 | 5/1950 | Walker | 323/89 T |
| 2,509,738 | 5/1950 | Lord | 328/89 B |
| 2,677,800 | 5/1954 | Phillips | 330/8 |
| 2,853,674 | 9/1958 | Gallatin | 323/89 M |

FOREIGN PATENT DOCUMENTS

| | | | |
|---|---|---|---|
| 981334 | 1/1976 | Canada | 323/75 S |

*Primary Examiner*—A. D. Pellinen

*Attorney, Agent, or Firm*—Kemon & Estabrook

[57] ABSTRACT

In order to prevent pulses induced in the excitation winding of a saturable reactor due to load current in the main winding from causing partial demagnetization of the core, a compensating coil of the same number of turns as the excitation winding is mounted on the core to generate pulses equal and opposite to the induced pulses. The compensating coil pulses are applied across an inductor connected in series with the main winding. A diode in series with the compensating coil prevents the excitation current from flowing through the coil.

3 Claims, 9 Drawing Figures

SATURABLE REACTORS

This invention relates to saturable reactor circuits for controlling alternating current electrical supplies to loads such as electric motors.

It is well-known to control the current fed to a load from an a.c. supply by connecting a saturable reactor in series with the load and adjusting the impedance of the reactor by variation of the magnitude of a direct current supply to one or more excitation windings on the reactor.

The impedance of the reactor can be set at any level between a maximum value, which is achieved for zero excitation current, and a minimum value which is obtained when the excitation current is large enough to cause saturation of the core of the reactor.

British Pat. No. 864,714 describes a number of saturable reactor arrangements comprising, for each phase of the supply, two cores of high permeability grain-orientated magnetic material. Each core has mounted thereon two identical winding sections which serve as the main current supply windings when connected in series with the load, which may, for example, be a squirrel cage induction motor.

The excitation windings are also formed as two identical winding sections on each of the two cores. These windings are connected in series and are connected across a d.c. supply via switching means.

In the arrangement described in Patent specification No. 864,714, the main windings are connected, in effect, in a bridge configuration with a supply connected to one corner of the bridge and an output to the motor being taken from the opposite corner. A diode is connected between the other corners of the bridge to enable unidirectional circulating currents to flow in the two halves of the bridge, thereby providing feedback which assists the excitation.

In our copending application Ser. No. 888,293 filed Mar. 20, 1978 we describe a saturable reactor arrangement which provides improved feedback.

It is an object of the present invention to provide a saturable reactor circuit including an improved circuit for feeding excitation current to the saturable reactors.

According to the invention, a saturable reactor circuit comprises at least one magnetic core on which are mounted main and excitation windings for carrying a.c. load current and d.c. excitation current, respectively; an inductor connected in series with the excitation winding or windings; and, connected across the inductor, a respective compensating coil for the or each excitation winding, the compensating coil being mounted on the core with its respective excitation winding and having the same number of turns as the excitation winding to apply across the inductor a voltage of opposite polarity to that in the excitation winding, and a diode in series with the compensating winding to inhibit the flow of the d.c. excitation current through the compensating winding or windings.

Figure 1:
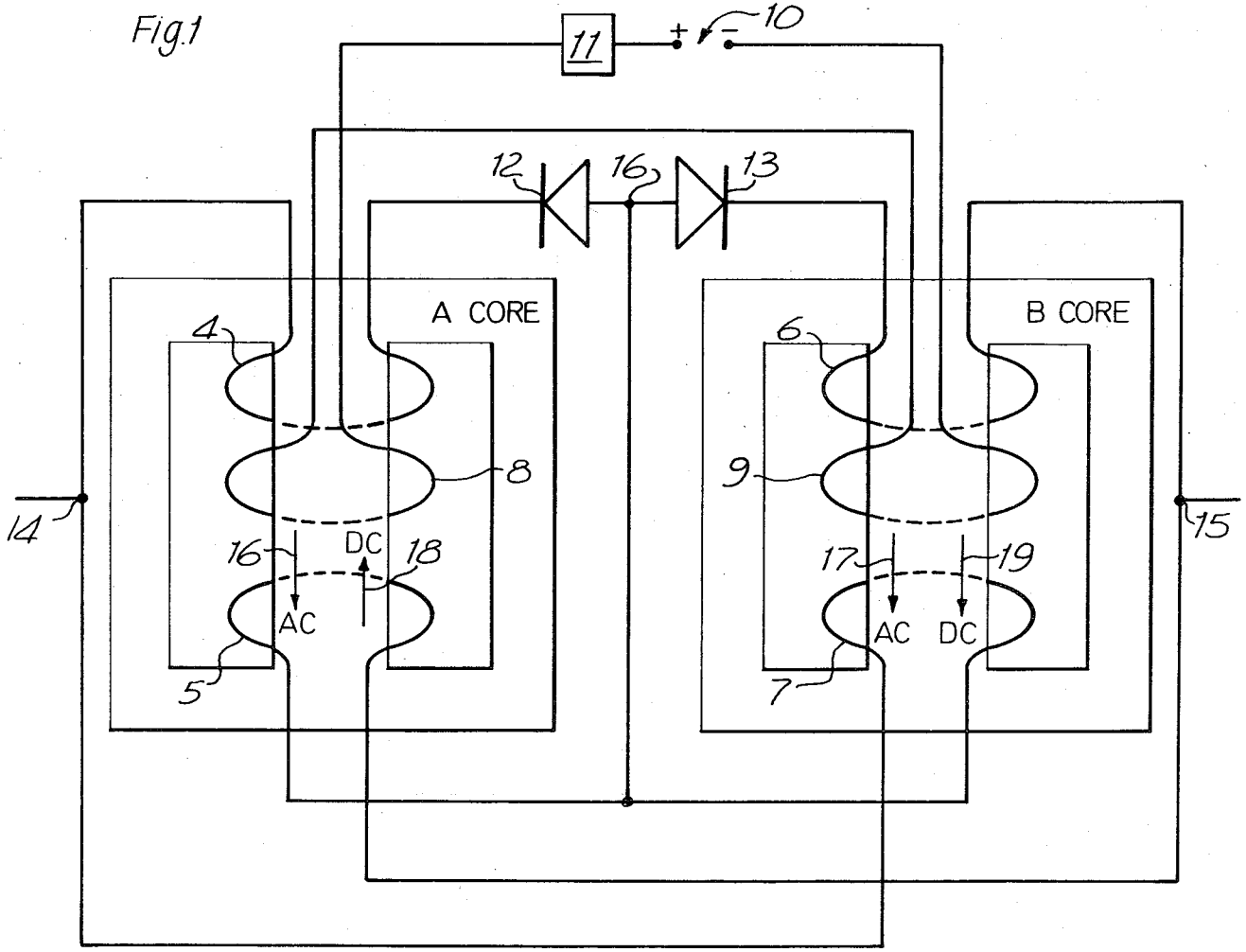

An embodiment of the invention will now be described, by way of example, with reference to the accompanying drawings, in which:

FIG. 1 is a schematic diagram of a saturable reactor circuit in accordance with our Application Ser. No. 888,293 filed Mar. 20, 1978.

Figure 2A:
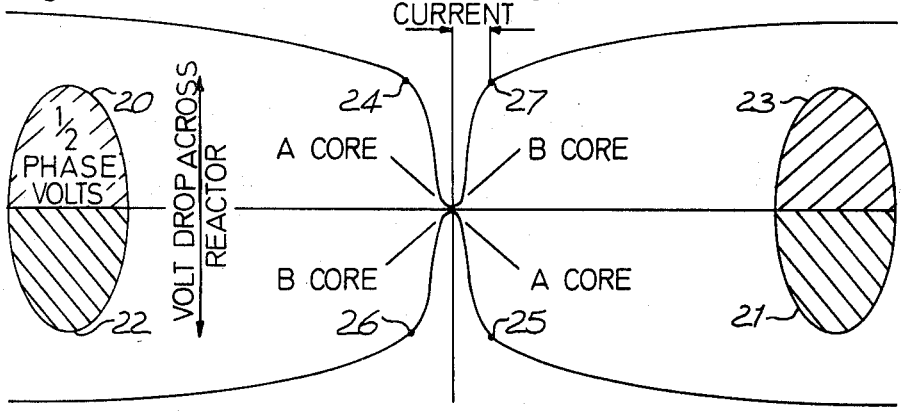
Figure 2B:
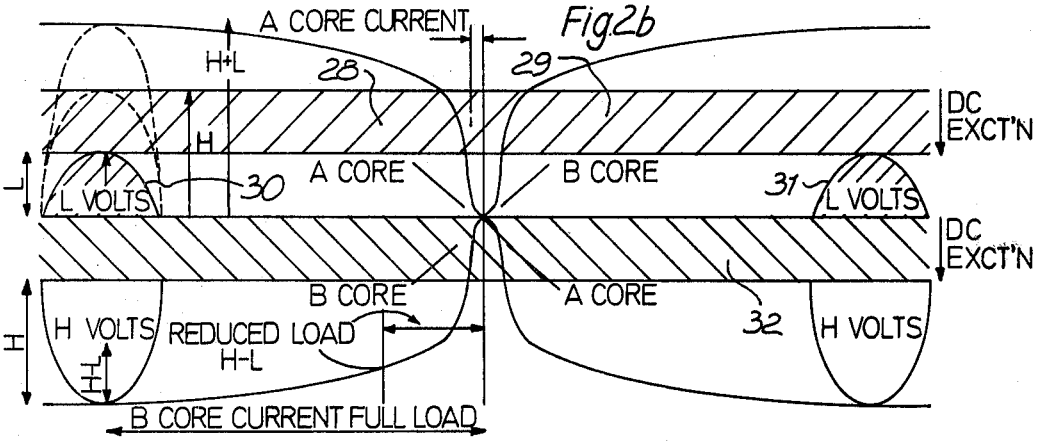
Figure 2C:
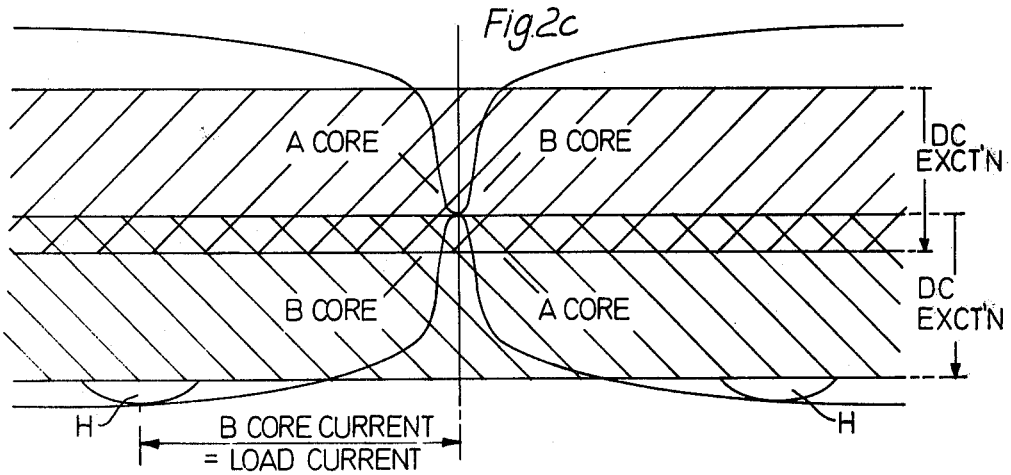
Figure 3:
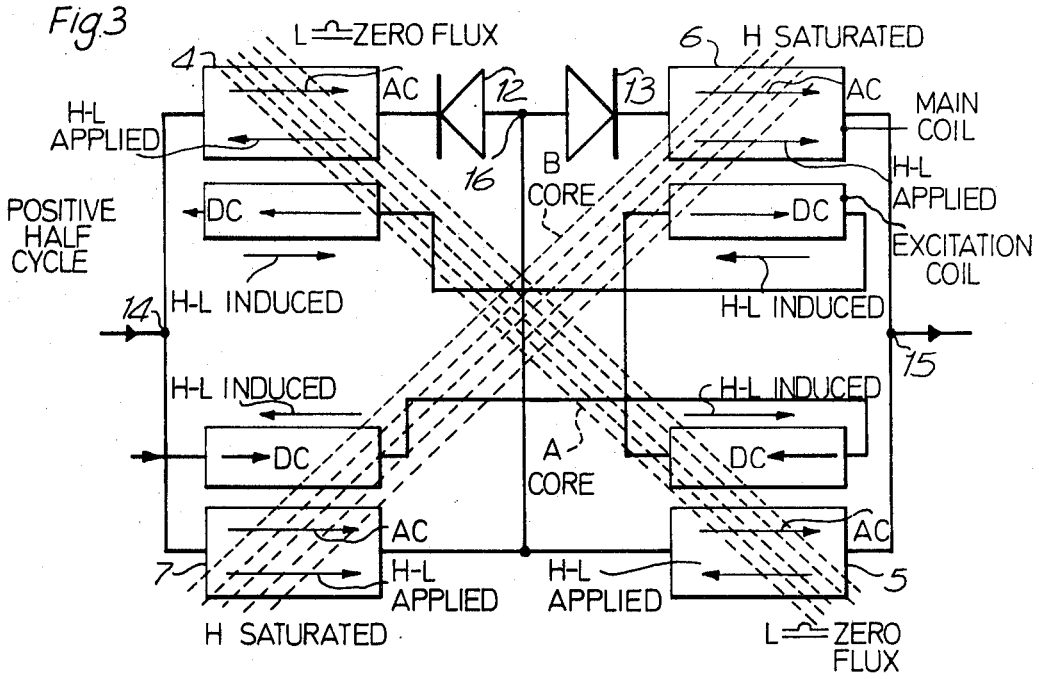
Figure 4:
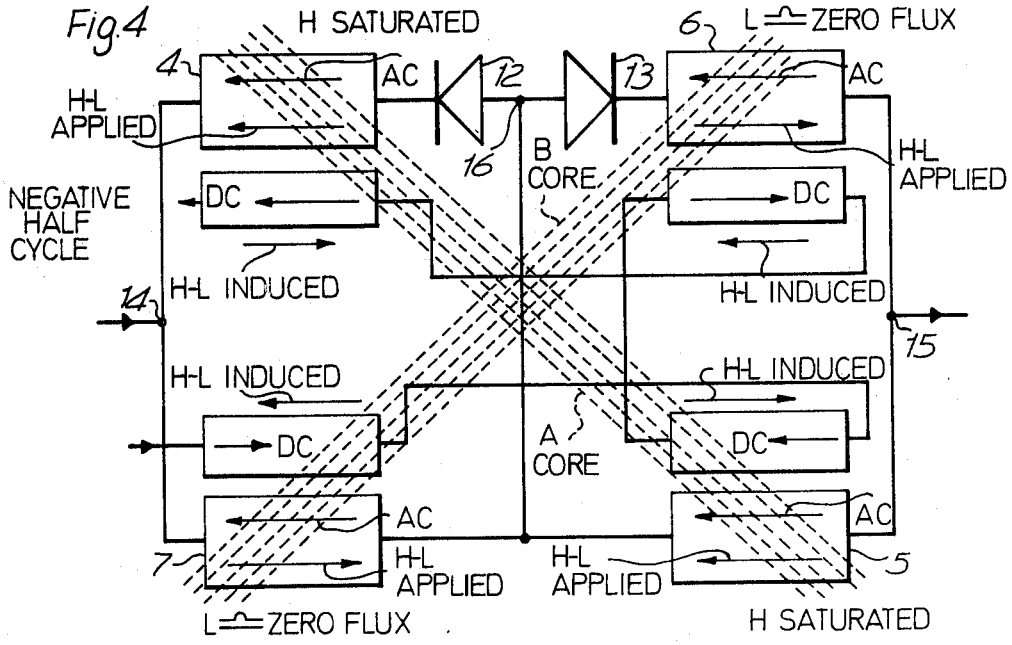
Figure 5:
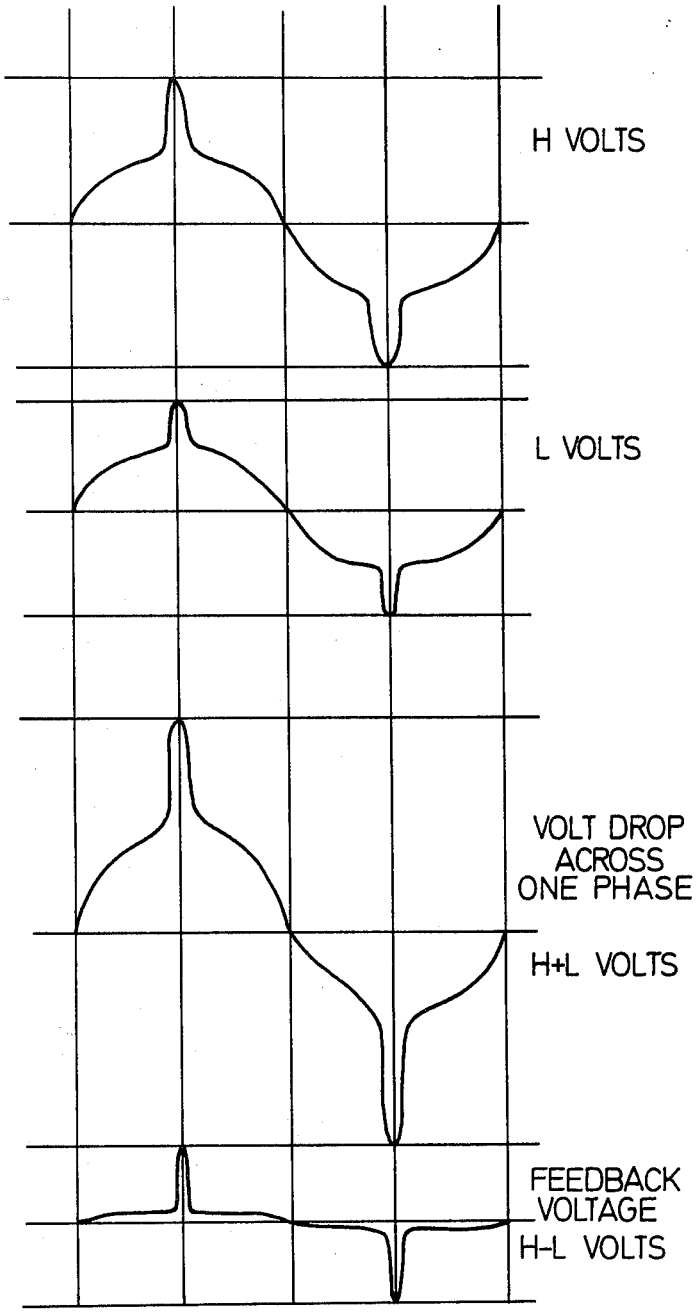
Figure 6:
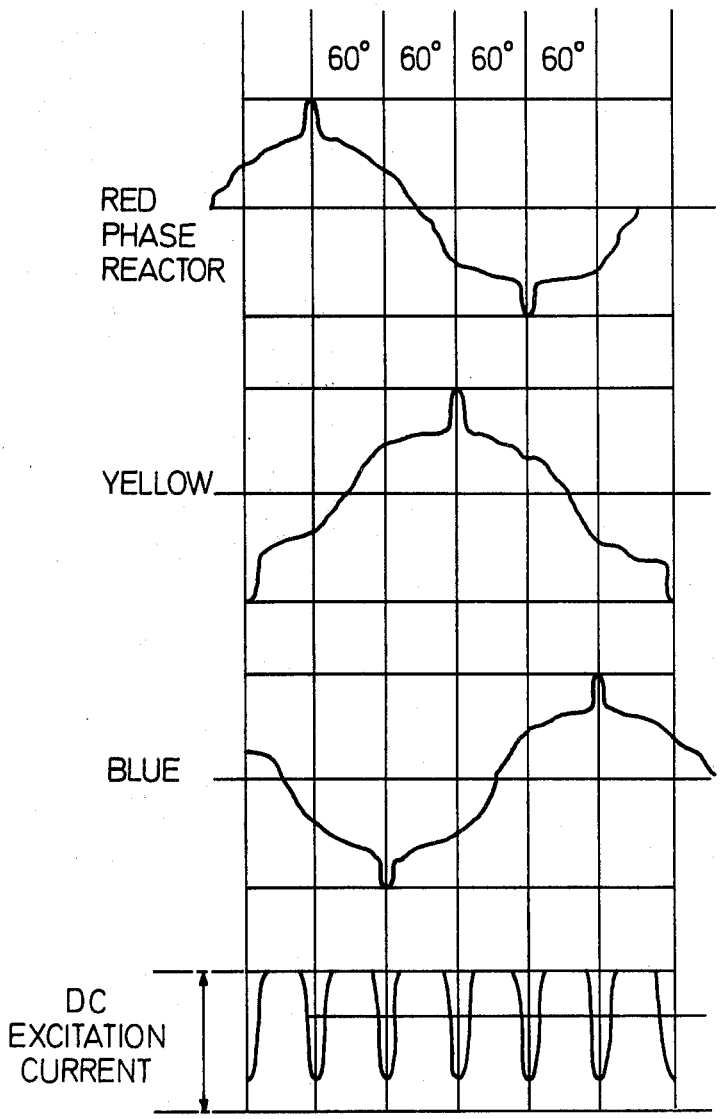
Figure 7:
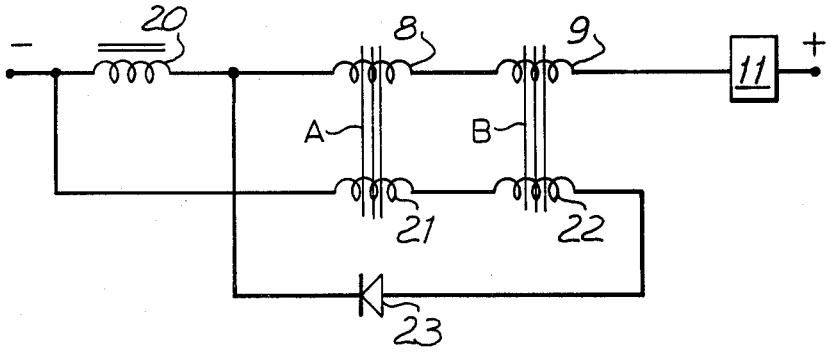

FIGS. 2(*a*) to 2(*c*) are curves illustrating the production of the feedback voltages in the saturable reactors of FIG. 1, FIGS. 3 and 4 show schematically the circuit of FIG. 1 indicating the instantaneous voltages therein for positive and negative supply half cycles, respectively, FIG. 5 illustrates waveforms occurring in the reactor circuit, FIG. 6 illustrates waveforms occurring in three such reactor circuits connected in a three phase supply to a load, and FIG. 7 is a schematic diagram of an excitation supply circuit as in the present invention.

The invention will be described as applied to the improved reactor circuit according to our Patent Application Ser. No. 888,293 filed Mar. 20, 1978, but clearly the invention can be applied to other reactor circuits.

Referring to FIG. 1 of the drawings, a saturable reactor circuit comprises two cores A and B on which are mounted pairs of main windings 4, 5 and 6, 7, respectively. Also mounted on the cores A and B are excitation windings 8 and 9, respectively, connected to a d.c. supply 10 via excitation current control means 11.

Diodes 12 and 13 are connected back-to-back, and their respective cathodes are connected to one end of the windings 4 and 6, respectively. The other end of the winding 4 is connected to an input point 14 and the other end of the winding 6 is connected to an output point 15.

One end of the winding 5 is connected to one end of the winding 7 and to the junction 16 between the diodes 12 and 13. The other end of the winding 5 is connected to the point 15, whilst the other end of the winding 7 is connected to the point 14.

In practice, three such circuits will normally be used, the points 14 of the circuits being connected to the respective lines of a three-phase supply, and the points 15 being connected to three input terminals of a three-phase load, such as an induction motor. Controlling the excitation current by adjustment of the control means 11 will vary the impedance of the main windings 4 to 7 and hence will vary the voltage applied to the load.

Arrows 16 and 17 indicate the directions of the alternating flux component produced in the cores A and B, respectively, due to the load current when the point 14 is positive with respect to the point 15. Arrows 18 and 19 indicate the directions of the flux components produced in the cores A and B, respectively, by the direct current flowing in the excitation windings 8 and 9.

It will be seen that the arrows 17 and 19 are in the same sense, so that the flux components are additive. Hence, the magnetisation level of the core B will be high, approaching saturation of the core.

On the other hand, the arrows 16 and 18 are in opposite senses, so that the flux components tend to cancel each other and the core A is in a near to zero magnetisation condition.

Referring also to FIG. 3, if the load current flow path is now traced for this positive half-cycle, it will be seen that the current flows from the point 14, through the winding 7 which has a low impedance since the core B is near saturation, through the diode 13, through the winding 6 which also has a low impedance for the same reason, and to the point 15.

In the negative half-cycle, the directions of the arrows 16 and 17 are reversed so that the arrows 16 and 18 are now in the same direction whilst the arrows 17 and 19 are in opposite directions. Referring also to FIG. 4, the core A is now near saturation, whilst the core B is near to zero flux. The load current now flows from the point 15, through the low impedance winding 5, through the diode 12, through the low impedance winding 4, and to the point 14.

For the sake of clarity the windings 4–9 in FIG. 1 are shown merely as single-turn windings, but clearly these windings will have any desired number of turns and may be sectionalised.

A high voltage H and a low voltage L are produced across the main windings depending upon whether they are at low impedance or high impedance, respectively. The production of these voltages will now be described with reference to FIGS. 2(*a*) to 2(*c*) of the drawings. Each of these figures represents diagrammatically the magnetisation curves for each core A and B for each half-cycle of the supply voltage.

FIG. 2(*a*) represents the condition wherein no excitation is applied to the windings 8 and 9. The reactor main windings are all in the high impedance state, so the phase voltage is dropped across the two reactors in series. Half of the phase voltage therefore appears across each reactor, indicated by the half-cycles 20 to 23. The magnetising current due to the applied voltage produces a flux density in the cores A and B rising to a maximum equal to the knee point values 24 to 27.

FIG. 2(*b*) represents the condition wherein an excitation current of approximately half full excitation level is applied to the windings 8 and 9. When the excitation flux opposes the a.c. flux, as indicated in the top half of FIG. 2(*b*), the excitation flux, as represented by the shaded area 28 pushes the flux density down from the knee point to a level 29. The voltage L across the reactors when in this low flux condition is dependent upon the difference between the a.c. flux density and the d.c. flux density as indicated by half-cycles 30 and 31.

In the other half-cycle of each reactor, the d.c. excitation flux in the cores is as indicated by the shaded area 32. This results in a voltage H appearing across the reactors in this low impedance condition. The difference between the voltages H and L causes circulation of feedback currents round the main windings 4 and 7 and around the main windings 5 and 6 as shown in FIGS. 3 and 4. These currents cause the production of extra flux in the cores aiding the flux produced by the excitation current. Clearly the larger the value H-L, the larger the feedback current will be and the lower the main winding impedance will be for a given excitation current, or conversely the lower the excitation current can be for a given winding impedance.

FIG. 2(*c*) illustrates that the valve of L becomes zero for full excitation, but that the value of H also reduces considerably. The value of H-L is therefore small and the advantage of the feedback is therefore lost if the excitation flux density is too high.

Since the main windings and the excitation windings are closely coupled to the cores, the main and excitation windings are also closely coupled to each other and current changes in the main windings will induce voltages in the respective excitation windings.

The circuit of FIG. 1 shows the winding arrangement for a single phase supply, but generally a three-phase or other polyphase supply will be used, and a similar circuit will be provided for each phase.

The excitation windings are then all connected together in series across a single d.c. supply, so that all of the voltages induced by the main windings of all three phases will appear in the excitation winding circuit.

The number of excitation windings provided can be any multiple of the number of main windings, the number being chosen such that the voltage across each winding is kept low. The ratio of excitation winding turns to main winding turns depends upon the rating of the equipment and the supply voltage.

The excitation windings are so interconnected that the voltages induced in those windings by the main windings at the fundamental frequency cancel out, and the overall resultant voltage across the excitation circuit at the fundamental frequency is substantially zero.

However, in each half cycle of the supply, voltage peaks are generated due to the high rate of change of current in the windings as the cores come out of saturation. These peaks are shown in FIG. 5, which relates to a single phase of the supply. The upper waveform in FIG. 5 is of the voltage across the low impedance (or H volts) windings, whilst the second waveform is of the voltage across the high impedance (or L volts) windings. The total voltage drop (=H+L volts) across the reactors of one phase is shown in the third waveform. The feedback voltage induced in the excitation windings in each half of the bridge, which voltage is proportional to the difference between H and L, is shown in the bottom waveform.

When all three phases are considered together, the resultant waveform are as shown in FIG. 6. It will be apparent that there are six peaks generated in each complete cycle of the supply. Corresponding peaks are induced in the excitation windings and act against the steady d.c. excitation current as shown in the bottom waveform in FIG. 3. Due to the configuration of the excitation windings, the peaks are all of the same polarity, acting against the d.c. excitation current. The result is a marked reduction in the useful excitation flux, resulting in a detrimental increase in the low impedance level of the conductive main windings.

It will be apparent that this impedance level must be the lowest which can be achieved, otherwise the power fed to the load will be reduced. This is particularly serious in the case where the load comprises a squirrel cage motor which takes a very large starting current, and where, if the starting current is unduly limited by the winding impedances, the starting torque will be drastically reduced.

A large increase in the excitation current fed from the d.c. supply to the excitation windings could counteract the result of the induced peaks, but this is clearly wasteful.

A smoothing circuit is therefore connected in the d.c. supply to the excitation windings. Referring to FIG. 7 which illustrates the circuit for a single phase, the circuit comprises an inductor 20 which is connected in series with the excitation windings 8 and 9, the series circuit being connected across the d.c. supply via the control unit 11. Across the inductor 20 are connected two compensating coils 21 and 22 in series with a diode 23.

The coils 21 and 22, which may be of quite small gauge wire, since they carry negligible current, are respectively mounted on the cores A and B so that they are closely coupled to the windings 8 and 9. The coils 21 and 22 have the same number of turns as the windings 8 and 9 and are so connected as to induce in the excitation circuit voltages of exactly the same magnitude and shape as the undesired peak voltages, but in phase opposition to those voltages. The undesirable peaks are therefore cancelled out by corresponding antiphase voltages induced in the compensating windings and applied across the inductor 20.

It is necessary to provide the diode 23 in series with the compensating windings so that the d.c. excitation current does not flow through the compensating windings. Clearly, if the excitation current were to flow through the compensating windings, which are wound in opposition to the excitation windings, the flux due to the excitation windings would be substantially cancelled out by that from the compensating windings, and it would not be possible to achieve the high flux/low impedance condition.

Modifications of the circuit could be made without departing from the scope of the invention. In particular, as mentioned previously, the invention is not limited to the saturable reactor configuration previously described.

I claim:

1. A saturable reactor circuit comprising: a magnetic core; main and excitation windings for carrying a.c. load current and d.c. excitation current, respectively mounted on said core; an inductor connected in series with said excitation winding; a compensating winding mounted on said core, connected across said inductor and inductively coupled to said excitation winding, said compensating winding having the same number of turns as said excitation winding to apply across said inductor a voltage of opposite polarity to that in said excitation winding; and a diode in series with said compensating winding to inhibit the flow of the d.c. excitation current therethrough.

2. A saturable reactor circuit comprising: a plurality of magnetic cores on each of which are mounted main and excitation windings for carrying a.c. load current and d.c. excitation current, respectively; an inductor connected in series with said excitation windings; and, connected across the inductor, a plurality of series-connected compensating windings mounted on the cores with and inductively coupled to respective excitation windings and having the same number of turns as said excitation windings to apply across said inductor a voltage of opposite polarity to that in said excitation windings; and a diode in series with the compensating windings to exhibit the flow of the d.c. excitation current therethrough.

3. A three phase saturable reactor circuit, comprising: in each phase, two magnetic cores on which are mounted main and excitation windings for carrying a.c. load current and d.c. excitation current, respectively; an inductor connected in series with said excitation windings; two series-connected compensating windings connected across said inductor, mounted on the respective cores and inductively coupled to said excitation windings thereon, said compensating windings having the same number of turns as said excitation windings to apply across said inductor a voltage of opposite polarity to that in said excitation windings; and a diode, connected in series with said compensating windings to inhibit the flow of the d.c. excitation current therethrough.

* * * * *